United States Patent [19]

Eichenlaub

[11] Patent Number: 4,510,718

[45] Date of Patent: Apr. 16, 1985

[54] HULL SANDING DEVICE

[75] Inventor: Carl Eichenlaub, San Diego, Calif.

[73] Assignee: Irving Loube, Oakland, Calif. ; a part interest

[21] Appl. No.: 466,438

[22] Filed: Feb. 15, 1983

[51] Int. Cl.[3] ..... B24B 23/06

[52] U.S. Cl. ..... 51/170 EB; 51/141

[58] Field of Search ..... 51/170 R, 170 EB, 141

[56] References Cited

U.S. PATENT DOCUMENTS 2,060,266 11/1936 Thompson ..... 51/170 EB 4,137,673 2/1979 La Tour ..... 51/141

FOREIGN PATENT DOCUMENTS 554314 1/1957 Italy ..... 51/170 EB

*Primary Examiner*—Roscoe V. Parker

*Attorney, Agent, or Firm*—Harris Zimmerman; Howard Cohen

[57] ABSTRACT

A device for sanding and finishing curved surfaces such as a boat hull includes a longitudinally extending upper member having a handle extending upwardly from a distal end and a motor assembly joined to the proximal end. A belt pulley is secured to the proximal end and driven by the motor, and a variable pitch pulley is supported at the distal end so that an endless sanding belt may be driven about the pulleys. A resilient and flexible pressure plate is secured fixedly to the ends of the upper member to support the sanding belt. The medial portion of the pressure plate is supported by an adjustable, resilient bracket assembly, so that the pressure plate may conform to curved surfaces and the belt may finish such surfaces smoothly and without gouging.

6 Claims, 5 Drawing Figures

HULL SANDING DEVICE

BACKGROUND OF THE INVENTION

It is well known by boat owners and operators that boat hulls require frequent maintainence, especially if the boat is docked in a salt water harbor. Regardless of the material which forms the hull, and regardless of the type of paint or other finish on the surface of the hull, barnacles, mineral deposits, algae, and other detritus of the sea quickly attach to the hull, altering the laminar flow lines of the hull and slowing the ship. The unfortunate result, for commercial boats, is the necessity to consume more fuel. For pleasure craft, the buildup of deposits on the hull is noticed more in the deterioration in the performance of the boat.

Consequently, it is necesssary regularly to remove a boat from the water and refinish the hull. Such refinishing usually requires scraping and removing the larger deposits, sanding the hull until smooth and streamlined once more, and then repainting the hull with paint that resists the corrosive effects of the sea. The devices available in the prior art for sanding the hull include disc sanders, vibrating orbital sanders, and belt sanders. Disc sanders are well known to cause gouges and irregular surface finishes, and are therefor unsuitable. Orbital sanders are extremely slow at removing surface material, and are thus suitable for the final steps of finish sanding, after the surface has been smoothed substantially. The only device that remains for performing most of the sanding work on a hull is the belt sander.

The standard belt sander known in the prior art employs and endless sanding belt circulating about a pair of pulleys, with an electric or gasoline motor driving one of the pulleys. The pulleys are generally no more than 12 inches apart, so that the effective sanding area is rather small. Also, a pressure plate is generally provided to support the portion of the belt which contacts the workpiece. The pressure plate is generally rigid and inflexible, so that the typical belt sander is suited for forming smooth planar surfaces.

However, the suitability of the typical belt sander for forming smooth, planar surfaces is a detriment for working on a curved boat hull which generally has no planar surfaces whatsoever. Due to this fact, extreme care must be taken in using a belt sander on a boat hull. The flat, rigid pressure plate of the sander tends to impinge the sanding belt onto the hull in an uneven fashion, causing streaking and gouging of the surface. For a skilled operator extreme care must be exercised at all times so that the hull may retain its smooth and streamlined configuration.

SUMMARY OF THE PRESENT INVENTION

The present invention generally comprises an improved belt sanding device particularly adapted for use in sanding and finishing curved surfaces such as boat hulls and the like. The device for sanding and finishing curved surfaces such as a boat hull includes a longitudinally extending upper member having a handle extending upwardly from a distal end and a motor assembly joined to the proximal end. A belt pulley is secured to the proximal end and driven by the motor, and a variable yaw pulley is supported at the distal end so that an endless sanding belt may be driven about the pulleys. A resilient and flexible pressure plate is secured fixedly to the ends of the upper member to support the sanding belt. The medial portion of the pressure plate is supported by an adjustable, resilient bracket assembly, so that the pressure plate may adjustably conform to curved surfaces and the belt may fully impinge upon such surfaces to finish the surfaces smoothly and without gouging.

DESCRIPTION OF THE PREFERRED EMBODIMENT

Figure 1:
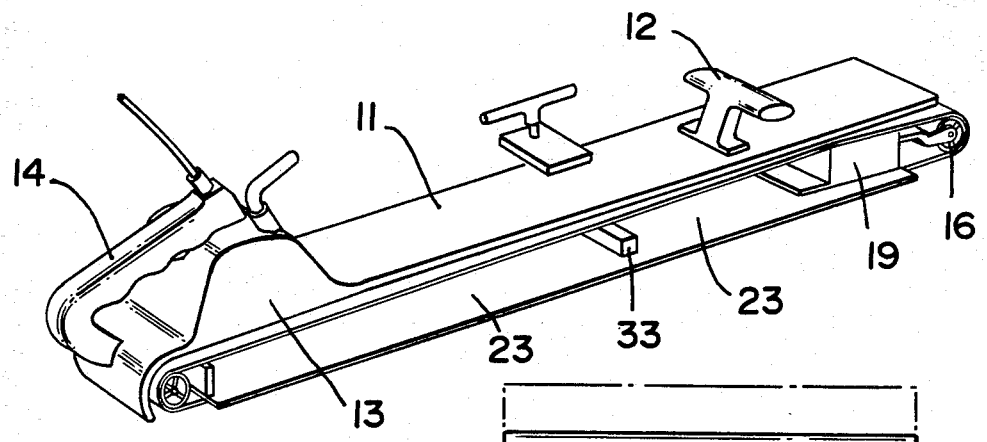
FIG. 1 is a perspective view of the curved surface sanding device of the present invention.
Figure 2:
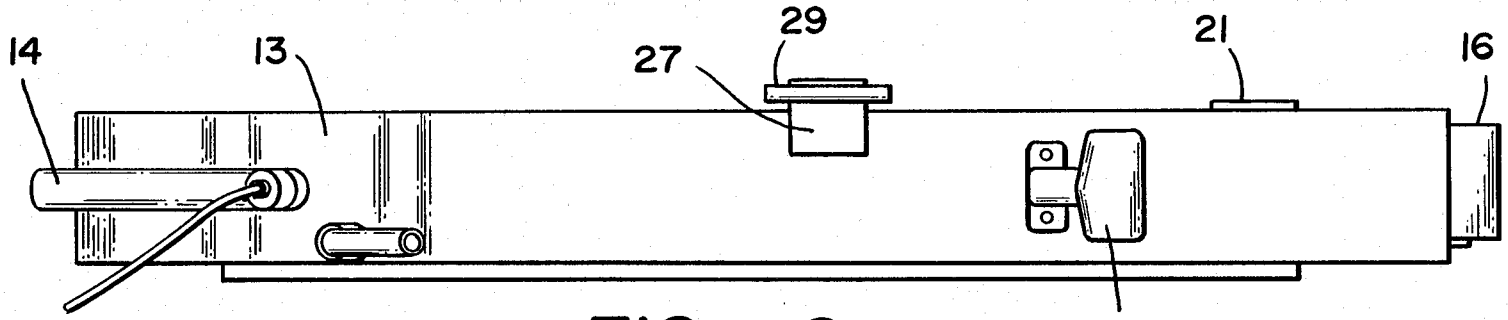
FIG. 2 is a top view of the curved surface sanding device of the present invention.
Figure 3:
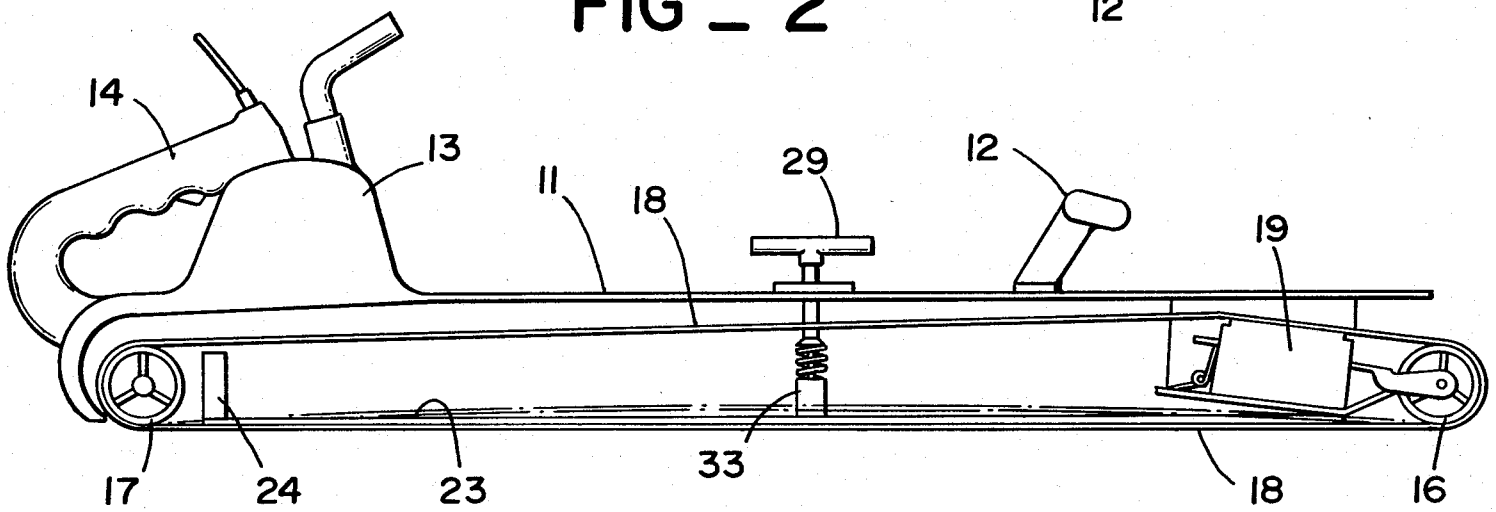
FIG. 3 is a side elevation of the device shown in FIGS. 1 and 2.

The present invention generally comprises an improved sanding device for smoothing and finishing curved surfaces such as boat hulls and the like. With reference to FIGS. 1–3, the device includes an upper support member 11 extending longitudinally and formed in generally planar fashion of high strength steel or plastic material. Extending upwardly from a distal portion of the member 11 is a forward handle 12. Joined to the proximal end of the member 11 is a motor drive assembly 13, which in the preferred embodiment is an electric motor coupled to a pulley drive assembly. A rear handle 14 extends upwardly from the proximal end of the member 11 and is joined to the upper surface of the motor housing.

The device also includes a forward belt pulley 16 and a rear belt pulley 17 about which an endless sanding belt 18 is driven in rotating fashion. The forward pulley 16 is supported by a pair of arms which extend from an adjustment mechanism 19 which is employed to selectively vary the yaw angle of the pulley 16. The mechanism 19, which is known in the prior art, is used to maintain the belt 18 centered on the pulleys as it is driven thereabout. The mechanism 19 is supported by a bracket 21 extending subjacently from the support member 11 at the distal end thereof.

The rear pulley 17 is supported by and extends from the motor drive assembly 13. The motor drive is coupled to the pulley 17 by a drive pulley to rotate the pulley 17 and drive the belt 18. Such arrangements are also known in the prior art.

A novel and salient feature of the present invention is the provision of a resilient and flexible pressure plate 23 extending longitudinally and subjacently of the support member 11. The distal end of the pressure plate is supported by the bracket 21, and the proximal end of the pressure plate is supported by a bracket 24 extending subjacently from the proximal end of the member 11. The pressure plate supports the portion of the belt 18 which contacts the workpiece, and is generally planar in configuration. However, the pressure plate 23 yields under pressure to deform in a gentle concave curve which conforms to a workpiece having a curvature of large radius, such a a boat hull. The flexible pressure plate assures that all of the length and breadth of the lower portion of the belt 18 contacts the curved workpiece. Thus the surfacing work is accomplished more quickly than with any prior art devices. More importantly, the yielding pressure plate causes the sanding belt to impinge evenly on the curved workpiece, preventing gouging of the workpiece and assuring that the curvature of the surface of the workpiece will be retained.

Figure 4:
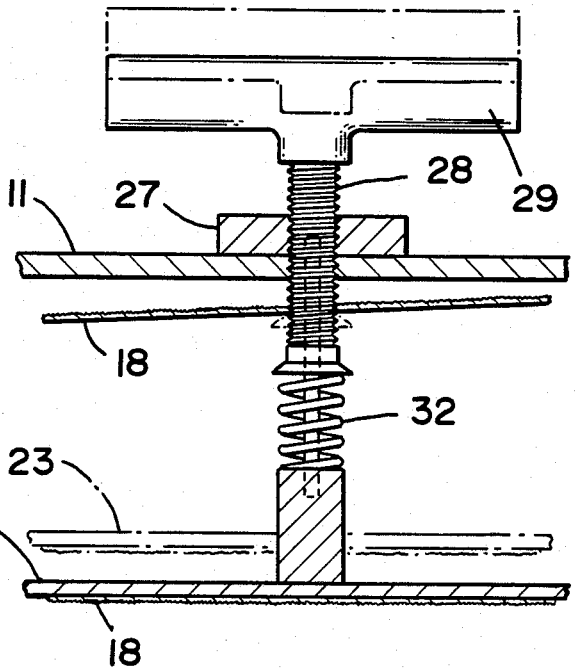
FIG. 4 is a cross-sectional side elevation of the resilient, adjustable bracket assembly of the sanding device of the present invention.
Figure 5:
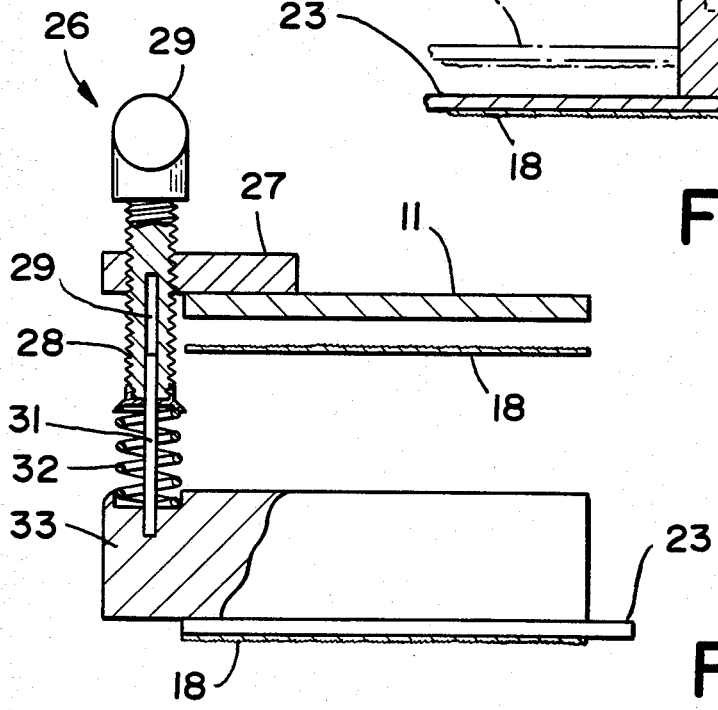
FIG. 5 is a cross-sectional end elevation of the bracket assembly depicted in FIG. 4.

With reference to FIGS. 4 and 5, the present invention also includes a pressure plate adjustment assembly 26 which selectively varies the amount of pressure which must be applied to the pressure plate to effect a desired amount of curvature thereof. The assembly 26 includes an arm 27 extending laterally from the support member 11, with a threaded rod 28 secured in a threaded hole extending through the arm 27. A handle 29 is joined to the upper end of the rod 28, and a bore 29 extends axially into the rod 28 from the lower end thereof.

Joined to a medial portion of the pressure plate 23 is an arm 33 which extends laterally therefrom. A guide pin 31 extends upwardly from the arm 33, and is received in slidable fashion in the bore 29 of the threaded rod 28. A helical compression spring 32 is secured to the arm 33 and disposed about the pin 31 to impinge upon the lower end of the rod 28. It may be appreciated that the handle may be rotated to advance the threaded rod 28 downwardly to compress the spring 32. This action increases the amount of pressure which must be exerted upon the pressure plate to cause it to conform to a curved surface. Likewise, the rod 28 may be retracted to permit the spring to relax, as shown in phantom line in FIG. 4, thus reducing the amount of pressure which is required to flex the pressure plate. The engagement of the guide pin in the bore of the rod 28 maintains the alignment of the arm 33 generally parallel to the upper member 11, so that the pressure plate remains generally parallel to the upper member. However, the pressure plate may diverge angularly to a slight degree to conform to surfaces having more than simple curved configurations.

It should be noted that the pressure applied to the pressure plate to cause it to conform to the surface of the workpiece is created by manually wielding the tool and pressing it against the surface of the workpiece with the belt 18 in motion. Thus the very act of using the tool causes it to conform to the workpiece.

I claim:

1. A device for sanding curved workpieces, comprising an elongated, longitudinally extending support member, pulley means for supporting an endless sanding belt, said pulley means including a pair of pulleys joined to opposed ends of said support member, motor means for driving one of said pulleys and said sanding belt, flexible pressure plate means for supporting said sanding belt between said pulleys and conforming to curved surfaces upon which said belt is impinged, said last mentioned means including a flexible and resilient pressure plate extending substantially the length of said support member, bracket means extending from opposed end portions of said support member for supporting said pressure plate, said pressure plate being sufficiently flexible to be deformable by manual impingement of said belt on the curved surface of the workpiece to conform to the curved surface, and pressure adjustment means for resiliently and yieldingly biasing a medial portion of said pressure plate with respect to said support member.

2. The device of claim 1, wherein said support member is generally planar in configuration, and said pressure plate is generally planar and parallel to said support member.

3. The device of claim 1, wherein said pressure adjustment means includes a first arm extending laterally from said pressure plate, and a compression spring extending therefrom towards said support member.

4. The device of claim 3, further including a second arm extending laterally from said support member, and a rod translatably supported by said second arm and disposed to impinge upon and compress said compression spring.

5. The device of claim 4, further including a bore extending axially in the lower end of said rod, and a guide pin extending upwardly from said first arm and slidably received in said bore.

6. The device of claim 5, wherein said rod includes an exterior threaded portion, and said second arm includes a threaded hole adapted to receive said exterior threaded portion.

* * * * *